US009835321B2

(12) United States Patent
Britt

(10) Patent No.: US 9,835,321 B2
(45) Date of Patent: Dec. 5, 2017

(54) LED MECHANICAL LIGHTING FIXTURE

(71) Applicant: Paul E. Britt, Los Angeles, CA (US)

(72) Inventor: Paul E. Britt, Los Angeles, CA (US)

( * ) Notice: Subject to any disclaimer, the term of this patent is extended or adjusted under 35 U.S.C. 154(b) by 0 days.

(21) Appl. No.: 14/803,587

(22) Filed: Jul. 20, 2015

(65) Prior Publication Data

US 2017/0023230 A1 Jan. 26, 2017

(51) Int. Cl.

| | |
|---|---|
| ***F21V 21/08*** | (2006.01) |
| ***F21V 29/77*** | (2015.01) |
| ***F21V 23/00*** | (2015.01) |
| ***F21V 31/00*** | (2006.01) |
| ***F21V 15/01*** | (2006.01) |
| ***F21V 29/503*** | (2015.01) |
| *F21Y 101/02* | (2006.01) |

(52) U.S. Cl.

CPC ..... *F21V 29/773* (2015.01); *F21V 15/01* (2013.01); *F21V 21/08* (2013.01); *F21V 23/001* (2013.01); *F21V 23/003* (2013.01); *F21V 29/503* (2015.01); *F21V 31/00* (2013.01); *F21Y 2101/02* (2013.01)

(58) Field of Classification Search

CPC .... F21V 29/773; F21V 23/003; F21V 23/001; F21V 31/00; F21V 21/08; F21V 15/01

See application file for complete search history.

(56) References Cited

U.S. PATENT DOCUMENTS 8,414,152 B2 4/2013 Yen
8,471,443 B2 * 6/2013 Choi ..... F21V 19/0035 313/45
8,764,251 B2 * 7/2014 Lien ..... F21V 29/2231 313/46
8,985,815 B2 * 3/2015 Chen ..... F21V 23/023 362/294
9,039,229 B2 5/2015 Xu
9,052,100 B2 6/2015 Blackstone
2008/0291677 A1 * 11/2008 Chen ..... F21V 15/01 362/249.01
2010/0091495 A1 * 4/2010 Patrick ..... F21V 29/004 362/249.02
2010/0165632 A1 * 7/2010 Liang ..... F21V 3/00 362/294
2010/0277917 A1 * 11/2010 Shan ..... F21V 15/01 362/249.02
2012/0057356 A1 * 3/2012 Hizer ..... F21V 29/63 362/373
2012/0195053 A1 * 8/2012 Wu ..... F21V 29/773 362/373
2012/0275165 A1 * 11/2012 Choi ..... F21K 9/00 362/294
2014/0211478 A1 * 7/2014 Park ..... F21V 29/02 362/294

(Continued)

*Primary Examiner* — Elmito Breval

(74) *Attorney, Agent, or Firm* — Sanford Astor

(57) ABSTRACT

An LED light unit which creates an air movement over a metal surface by way of convection. This keeps the LED unit significantly cooler than with just fins alone. This is accomplished by the design of a lamp. The LED chip transfers the heat to the metal surface and the hot air near that metal rises and starts a flow through channels designed into the lamp. This brings in cooler air over the metal surface in a directed method by convection to achieve better cooling of the LED chip area.

10 Claims, 5 Drawing Sheets

(56) References Cited

U.S. PATENT DOCUMENTS

| | | | | |
|---|---|---|---|---|
| 2014/0313732 | A1* | 10/2014 | Kang | F21V 29/004 362/294 |
| 2015/0049495 | A1* | 2/2015 | Chen | F21V 29/507 362/373 |
| 2015/0085503 | A1* | 3/2015 | Na | F21V 29/40 362/373 |
| 2016/0084490 | A1* | 3/2016 | Davis | F21K 9/23 362/373 |
| 2016/0186981 | A1* | 6/2016 | Chen | F21K 9/232 362/373 |

* cited by examiner

LED MECHANICAL LIGHTING FIXTURE

TECHNICAL FIELD

The invention relates to a mechanical lighting fixture comprising an LED light.

BACKGROUND

LED lights are becoming more popular because they provide more light, yet use less power than older lighting systems. With new LED lighting, heat management is a significant issue. LED lights generate high heat, and if not cooled, will shorten the life of an LED. The LED light consists of an LED chip and a driver circuit. The LED chip gets hot and the heat needs to be dissipated or the LED chip and the driver will be damaged. Various methods have been proposed for cooling an LED light. These methods include fans and flat metal plates. The current model is to use normal heat sinks with metal fins which radiate heat from the surface of the fin to the air surrounding it.

SUMMARY

The method of this invention creates an air movement over a metal surface by way of convection. This keeps the LED unit significantly cooler than with just fins alone. This is accomplished by the design of the lamp. The LED chip transfers the heat to the metal surface and the hot air near that metal surface rises and starts a flow through channels designed into the lamp. This brings in cooler air over the metal surface in a directed method to achieve better cooling on the chip area. Applicant's lamp is especially useful in indoor facilities, such as parking garages, where the LED lamps provide significant more lighting than existing florescent lighting at less cost. However, Applicant's lamp, with some modification, are also very useful for outdoor lighting.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 2:
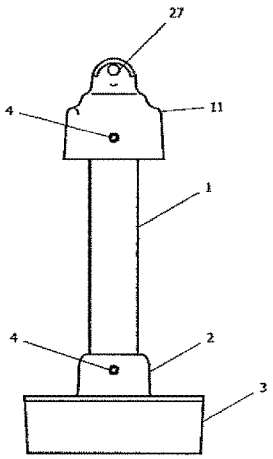
FIG. 2 is a front view of the lamp of this invention.
Figure 1:
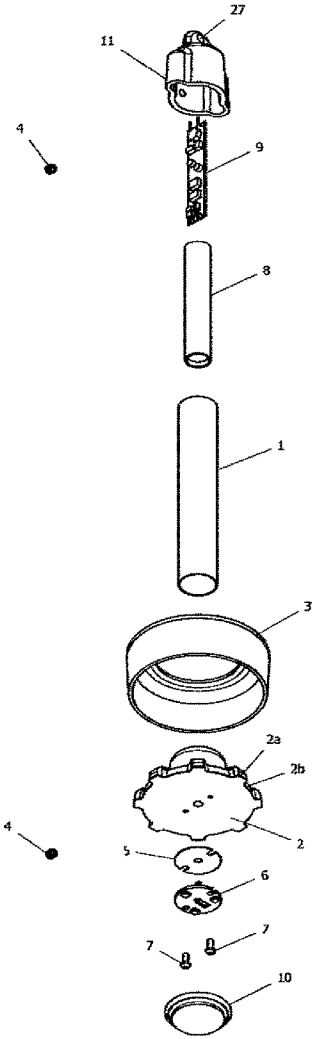
FIG. 1 is an exploded view of the lamp of this invention.

Referring now to the drawings, FIGS. 1 through 5 show an exploded view of the LED mechanical lamp in FIG. 1 and other views in FIGS. 2-5. Starting from the top of FIG. 1, is a water resistant cap 11 which is connected to tube 1, which is a driver housing and provides a wire entry through tube 1. Cap 11 has a hanger 27 at the top of cap 11 for hanging the lamp to a roof, ceiling or other location.

Driver circuit board 9 modifies current and voltage to match LED requirements, and fits into tube 8, which is a potting capsule for driver circuit board 9. Tube 8 fits into tube 1. Metal module 2 has a plurality of fins 2*a*, forming a plurality of inserts or channels 2*b*, to create heat channels. Metal cover 3 is a shroud to complete and cover of the air channels creating an air duct and also to direct the LED 6 light. Set screw 4 mechanically attaches module 2 to tube 1.

LED chip set on a circuit board 6 is attached to metal module 2. Optionally, LED circuit board 6 can be attached to a heat transfer pad 5 by any convenient method such as screws or can be glued to heat transfer pad 5. Heat transfer pad 5 helps to dissipate heat from circuit board 6. Screws 7 attach LED circuit board 6 to module 2. A protective lens 10 attaches to module 2 by glue or a mechanical method, such as a retaining ring.

With LED lighting heat management is a significant issue. The LED chip set gets hot and the heat needs to be dissipated or the LED chip and the driver will be damaged. The current method is to use normal heat sinks with metal fins which radiate heat from the surface of the fins to the air surrounding it. Fans have also been used.

The system created by the lamp of this invention described above, creates air movement over the metal surface via convection. This keeps the unit significantly cooler than with fins alone. This is done by the design of the lamp. The LED chip circuit board 6 transfers the heat to the surface of metal module 2 and the hot air near metal module 2 rises, and by convection, starts a flow of air up through the channels 2*b* between fins 2*a* in metal module 2, surrounded by cover 3. This brings in cooler air over the metal surface of module 2 in a directed method to achieve better cooling on the chip area.

Figure 3:
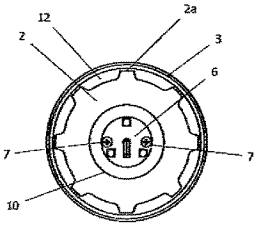
FIG. 3 is a bottom view of the lamp.

FIG. 3 is a bottom view of the lamp and shows the lamp module 2, the shroud 3, the LED circuit board 6, and screws 7 to attach the LED circuit board 6 to module 2. Also shown is lens 10 which is a protective lens for the LED. Lens 10 can be attached to module 2 by glue or a mechanical method.

Figure 4:
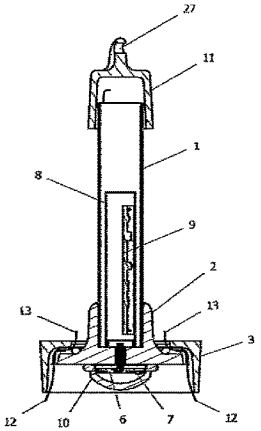
FIG. 4 is a cross-sectional view of FIG. 2.

An air path intake 12 provides a path for cooler air to enter due to the draft of the hot air rising, shown in more detail in FIG. 4. Item 12 points to one air path intake channel, but there will be a plurality of air path intake channels depending upon the design of lamp module 2. Eight air path intake channels 12 are shown in FIG. 3

Referring to FIG. 4 there is shown metal tube 1 which is a driver housing, used to contain the driver assembly 9 in tube 8, the lamp module 2, shroud 3, LED circuit board 6 and screws 7 to attach LED circuit board 6 to module 2, all previously described. Also shown are potted driver capsule 8, driver circuit board 9, lens 10, and cap 11, also previously described. Lines 12-13 depict the air path, showing air path intake 12, and air path exit 13. Heated air, in contact with the upper surface of lamp module 2, exits upward, thereby creating a convection draft, to pull cool air through the air path channels 12, cooling module 2 and LED circuit board 6.

Figure 5:
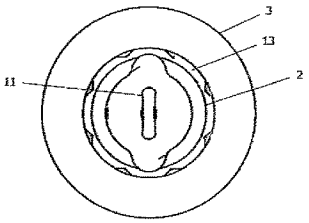
FIG. 5 is a top view of the lamp.

FIG. 5 is a top view of the lamp showing lamp module 2, shroud 3 cap 11 and air path exit 13. Wires passing from driver circuit board 9, up inside cap 11 to a power source, are internal and not shown.

Figure 6:
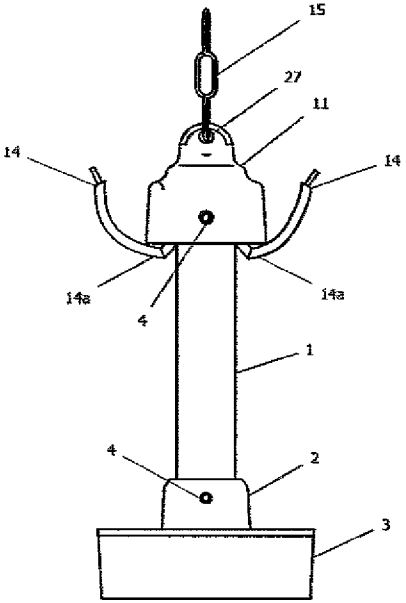
FIG. 6 is a front view of a wired lamp.

FIG. 6 shows another embodiment of the lamp in which parts 1 through 11 are the same as described above. Shown in FIG. 6 is a typical chain 15 used to hang a lamp. Wires 14 connect driver circuit board 9 to a power source. This lamp can be used indoors but can also be used outdoors, since any water, such as rain water, will run down the wire and drip off the lowest point of the wire 14*a* away from the internal electronics. This lamp will withstand heavy rainfall without water entry and does not need to be sealed to stay dry.

Figure 7:
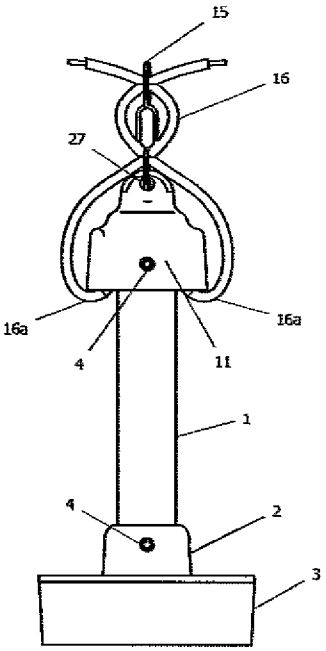
FIG. 7 is a front view of another wired lamp.

FIG. 7 shows another embodiment of the lamp in which parts 1 through 11 are the same as described above. In this embodiment there is a typical chain 15, used to hang a lamp. Wire 16 is looped through chain 15, and again, this lamp can be used indoors but can also be used outdoors since the lowest point of the wire 16*a* is where any water, such as rain water, must drip, away from the LED. This lamp will withstand heavy rainfall without water entry and does not need to be sealed to stay dry.

Figure 9:
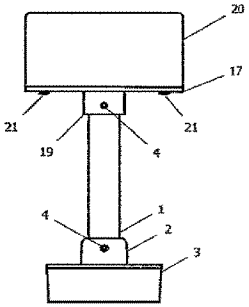
FIG. 9 is a front view of the lamp of FIG. 8.
Figure 8:
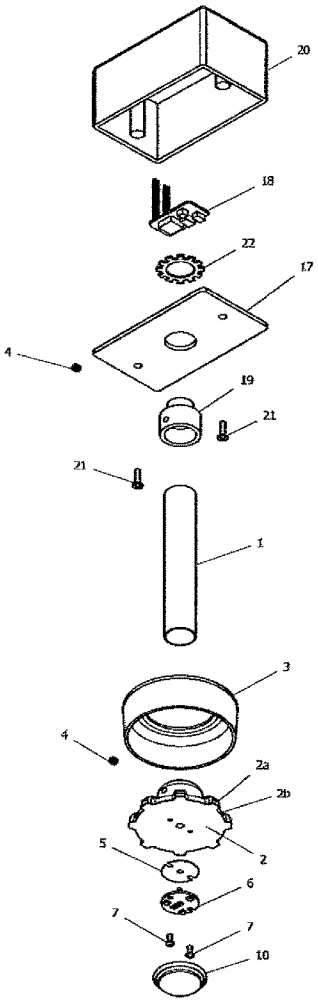
FIG. 8 is a an exploded view of a junction box lamp.

FIGS. 8 and 9 show another embodiment of the lamp in which parts 1 through 10 are the same as described above, except there is not a driver circuit board 9 or a potted driver 8. In this embodiment, there is a standard junction box 20 which contains a driver circuit board 18 and a retainer ring 22 for conduit tube connector 19. Cover plate 17 is a standard one hole cover plate for a standard junction box, using screws 21 to attach to junction box 20. Tube connector 19 is a standard conduit connector held by screw 4.

Figure 11:
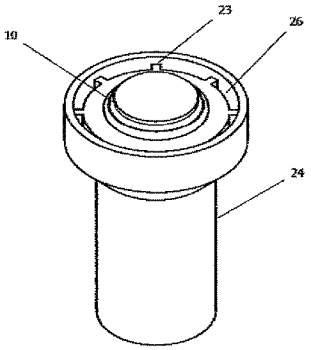
FIG. 11 is a top perspective view of the lamp of FIG. 10; and,
FIG. 12 is a bottom perspective view of the lamp of FIG. 10.
Figure 12:
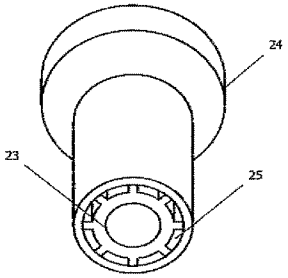
Figure 10:
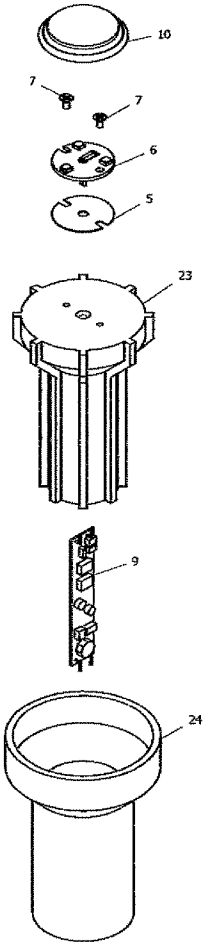
FIG. 10 is an exploded view of an upper directed lamp.

FIGS. 10, 11 and 12 show another embodiment of the lamp using the convection cooling system for LED modules that are pointed up, to provide an upper shining LED light. Parts 5, 6, 7, 9 and 10 are the same as described above. Referring to FIG. 10 there is shown from the top, a lens 10, screws 7 to attach LED circuit board 6 and an optional heat transfer pad 5 to metal lamp module 23. Driver circuit board 9 fits into metal lamp module 23 which is covered by shroud 24, which covers all of the parts with the light shining upward. Heat, at the LED and metal lamp module 23, rises as hot air rises.

FIG. 11 is a top perspective view of the upward lamp, showing shroud 24, lens 10, metal lamp module 23 and one of a plurality of air path exits 26. FIG. 12 is a bottom perspective view of the upward lamp showing shroud 24, lamp module 23 and one of a plurality of air path intakes 25. Cool air enters at air path intakes 25 and rises through air path exits 26, cooling lamp module 23 and LED circuit board 6.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An LED mechanical lamp comprising an LED circuit board affixed to a metal module having a surface having a plurality of fins forming a plurality of open channels, a solid metal shroud having a central hole, the shroud placed over the metal module, to complete and cover the air channels creating an air duct, the LED circuit board generating heat and transferring the heat to the surface of the metal module causing an air intake providing a path for upward hot air flow through the center hole of the shroud, and by convection causing a flow of cool air to enter, due to the hot air uprising through the center hole causing cool air passage through the channels between the fins in the metal module surrounded by the solid metal shroud creating a convection draft to pull cool air through the intake of the air path horizontal channels bringing cool air over the metal module surface in a directed method over the LED board, cooling the metal module at its hottest point of contact with the LED circuit board.

2. The LED mechanical lamp of claim 1 in which a thermal heat transfer pad is attached to the LED circuit board.

3. The LED mechanical lamp of claim 1 further comprising a driver circuit board which fits into a tube attached to the metal module.

4. The LED mechanical lamp of claim 1 in which a lens is attached to the metal module.

5. The LED mechanical lamp of claim 1 in which the metal module has eight channels.

6. An LED mechanical lamp comprising an LED circuit board affixed to a metal module having a surface having a plurality of fins forming a plurality of open channels, a solid metal shroud having a central hole, the shroud placed over the metal module, to complete and cover the air channels creating an air duct, the LED circuit board generating heat and transferring the heat to the surface of the metal module causing an air intake providing a path for upward hot air flow through the center hole of the shroud, and by convection causing a flow of cool air to enter, due to the hot air uprising through the center hole causing cool air passage through the channels between the fins in the metal module surrounded by the solid metal shroud creating a convection draft to pull cool air through the intake of the air path horizontal channels bringing cool air over the metal module surface in a directed method over the LED board, cooling the metal module at its hottest point of contact with the LED circuit board, a driver circuit board inside of a tube in which wires run from the driver circuit board into the cap and are attached to a power source.

7. The LED mechanical lamp of claim 6 in which a thermal heat transfer pad is attached to the LED circuit board.

8. The LED mechanical lamp of claim 6 in which a lens is attached to the LED circuit board.

9. The LED mechanical lamp of claim 8 in which the power wires exit out of the cap in a downward manner and then curve in an upward manner, thereby providing rain protection for internal electronics.

10. An LED mechanical lamp comprising an LED circuit board affixed to a metal module having a surface having a plurality of fins forming a plurality of open channels, a solid metal shroud having a central hole, the shroud placed over the metal module, to complete and cover the air channels creating an air duct, the LED circuit board generating heat and transferring the heat to the surface of the metal module causing an air intake providing a path for upward hot air flow through the center hole of the shroud, and by convection causing a flow of cool air to enter, due to the hot air uprising through the center hole causing cool air passage through the channels between the fins in the metal module surrounded by the solid metal shroud creating a convection draft to pull cool air through the intake of the air path horizontal channels bringing cool air over the metal module surface in a directed method over the LED board, cooling the metal module at its hottest point of contact with the LED circuit board, a junction box containing a driver circuit board which modifies current and voltage to match LED requirements and connects to a power source.

* * * * *